US005655876A

United States Patent [19]

Rock et al.

[11] Patent Number: 5,655,876

[45] Date of Patent: Aug. 12, 1997

[54] LOW LEAKAGE TURBINE NOZZLE

[75] Inventors: Peter J. Rock, Byfield; Joseph K. Bussichella, Winchester; John W. Vdoviak, Marblehead, all of Mass.

[73] Assignee: General Electric Company, Cincinnati, Ohio

[21] Appl. No.: 581,822

[22] Filed: Jan. 2, 1996

[51] Int. Cl.[6] ..... F01D 5/20

[52] U.S. Cl. ..... 415/139; 415/138

[58] Field of Search ..... 415/139, 136, 415/138

[56] References Cited

U.S. PATENT DOCUMENTS

| | | | |
|---|---|---|---|
| 3,650,635 | 3/1972 | Wachtell et al. | 415/115 |
| 3,661,477 | 5/1972 | Westrum | 415/139 |
| 3,975,114 | 8/1976 | Kalkbrenner | 415/138 |
| 4,509,238 | 4/1985 | Lee et al. | 429/156.8 R |
| 4,701,102 | 10/1987 | Pisz et al. | 415/139 |
| 4,762,462 | 8/1988 | Lardellier | 415/139 |
| 4,818,834 | 4/1989 | Rupert | 219/69.17 |
| 5,409,415 | 4/1995 | Kawanami et al. | 451/39 |
| 5,531,457 | 7/1996 | Tibbott et al. | 415/139 |

*Primary Examiner*—Edward K. Look
*Assistant Examiner*—Mark Sgantzos
*Attorney, Agent, or Firm*—Andrew C. Hess; Wayne O. Traynham

[57] ABSTRACT

A turbine nozzle includes a circumferentially continuous annular outer band, and a plurality of circumferentially spaced apart vanes extending radially inwardly therefrom. A circumferentially segmented inner band is joined to the vanes and is disposed coaxially with the outer band. The inner band includes a plurality of circumferentially adjoining arcuate segments, adjacent ones of which have circumferentially facing end faces spaced apart to define a gap therebetween. In an exemplary embodiment, strip seals are inserted in corresponding slots formed in the end faces to seal leakage therebetween.

13 Claims, 3 Drawing Sheets

LOW LEAKAGE TURBINE NOZZLE

The US Government has rights in this invention in accordance with Contract No. DAAEO7-84-C-R083 awarded by the Department of the Army.

BACKGROUND OF THE INVENTION

The present invention relates generally to gas turbine engines, and, more specifically, to a turbine nozzle therein.

In a gas turbine engine, air is compressed in a compressor and mixed with fuel and ignited in a combustor for generating hot combustion gases which flow downstream therefrom through one or more turbine stages each including a turbine nozzle and rotor blades. Each turbine nozzle includes a plurality of circumferentially spaced apart hollow airfoil vanes extending radially between and joined to radially outer and inner bands. During operation, the hot combustion gases flow between the adjacent vanes to the turbine blades for extracting energy therefrom. Each passage between adjacent vanes has a preferred minimum throat area which must be accurately controlled for controlling efficiency of operation of the turbine. The turbine nozzle is typically cooled with a portion of air bled from the compressor for ensuring an effective useful life thereof.

Since the engine operates at varying output power, the turbine nozzle experiences increasing and decreasing temperature which varies due to the effects of the heating combustion gases and the cooling air. Experience has shown that the use of annular outer and inner bands for supporting the vanes is undesirable because they restrain thermal growth and contraction of the vanes causing unacceptably high transient thermal stresses which significantly reduce the useful life of the nozzle. The temperature and stress operation of the nozzle is relatively complex and also includes differential temperature gradients of the components which also create undesirable thermal stress during operation, with the annular outer and inner bands causing increased thermal stress and distortion.

Accordingly, modern turbine nozzles are formed in circumferential segments with one or more vanes being fixedly joined in a corresponding segment with arcuate outer and inner band segments, By segmenting the outer and inner bands, hoop restraint is eliminated and therefore the vane segments are allowed to thermally expand and contract without restraint. The resulting thermal stresses are significantly reduced for ensuring a suitable useful life of the nozzle. However, segmenting the turbine nozzle increases the complexity of the nozzle and the manufacturing process for ensuring efficient aerodynamic performance during operation. Each nozzle segment must be accurately constructed and machined individually, and then accurately assembled and aligned with the other nozzle segments to form the complete annulus. Additional care must be used for accurately creating the individual vane throat areas in each nozzle segment and between adjacent ones of the nozzle segments.

Furthermore, the segmented turbine nozzle creates potential leakage flowpaths between the segments which is undesirable if cooling air is allowed to leak into the combustion gas flowpath which decreases efficiency of the engine. Accordingly, the circumferential end faces of each of the outer and inner band segments is typically provided with a spline strip seal trapped within a pair of complementary slots for sealing the circumferential gaps between adjacent bands. The complex temperature environment of the turbine nozzle includes axial and radial temperature gradients which may cause misalignment of the spline seals during operation leading to undesirable leakage therearound.

Yet further, in low solidity turbine nozzles having relatively few vanes, the vane chords are relatively large, with a correspondingly large aspect ratio of the chord length over the chord height which increases the axial length of the end gaps which typically extend diagonally between the angled nozzle vanes. The longer joints are more prone to leakage. And, the long aspect ratio increases the potential mismatch of the spline seal slots during operation.

Another consideration is engine size. The smaller the engine, the more difficult it is to effect suitable spline seals. And, in single stage turbines which operate at high pressure ratio, cooling air leakage in the nozzle segments increases aerodynamic efficiency losses during operation.

SUMMARY OF THE INVENTION

A turbine nozzle includes a circumferentially continuous annular outer band, and a plurality of circumferentially spaced apart vanes extending radially inwardly therefrom. A circumferentially segmented inner band is joined to the vanes and is disposed coaxially with the outer band. The inner band includes a plurality of circumferentially adjoining arcuate segments, adjacent ones of which have circumferentially facing end faces spaced apart to define a gap therebetween. In an exemplary embodiment, strip seals are inserted in corresponding slots formed in the end faces to seal leakage therebetween.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
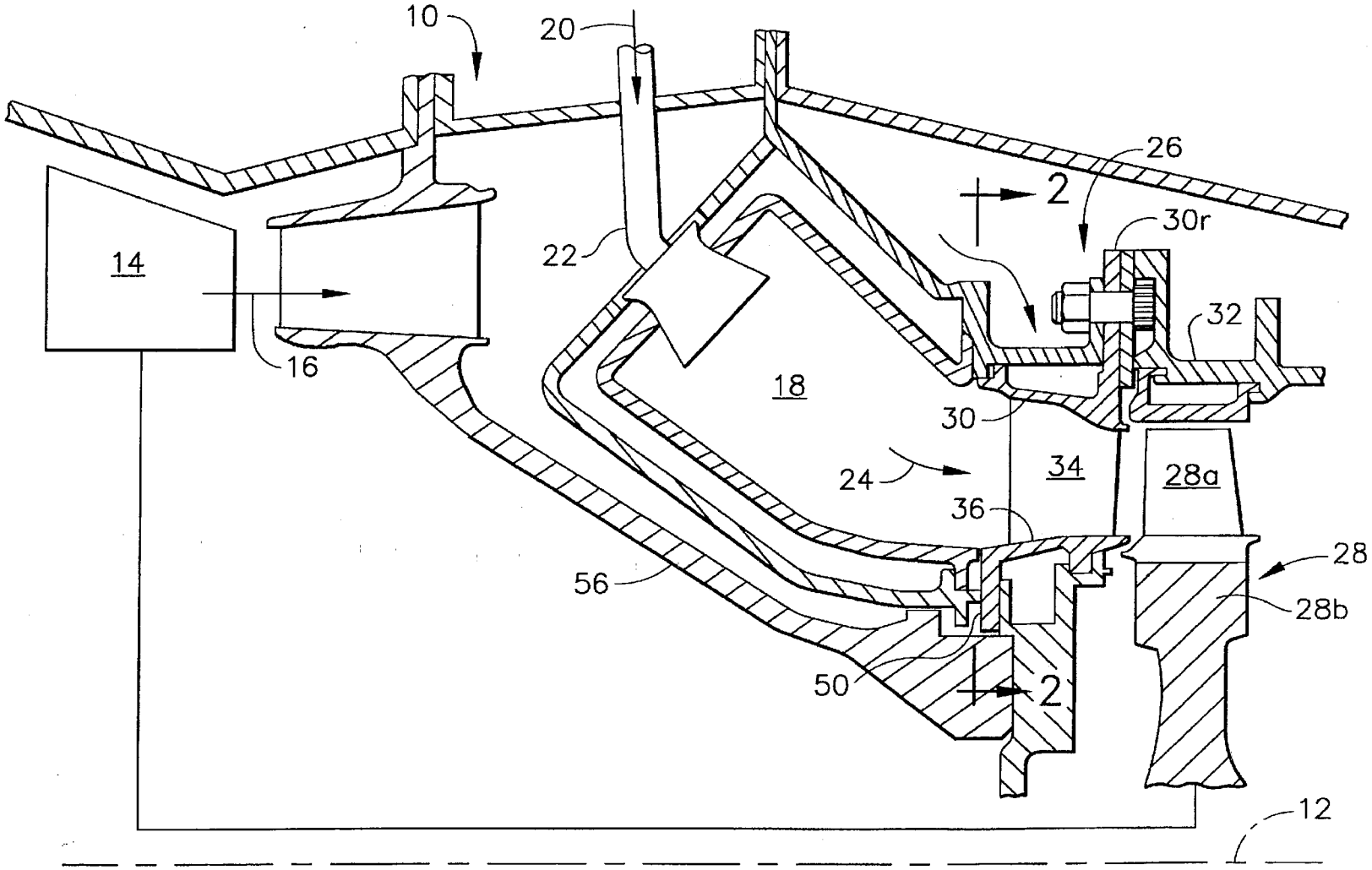
FIG. 1 is an elevational, partly sectional schematic view of an exemplary gas turbine engine including a turbine nozzle in accordance with one embodiment of the present invention.

Illustrated schematically in FIG. 1 is a portion of an exemplary gas turbine engine 10 which is axisymmetric about a longitudinal centerline axis 12 and includes a conventional compressor 14 for pressurizing air 16 which is channeled to a conventional combustor 18 wherein it is mixed with fuel 20 channeled through conventional fuel injectors 22 and conventionally ignited for generating hot combustion gases 24.

A high pressure turbine nozzle 26 in accordance with one embodiment of the present invention is suitably mounted at the outlet of the combustor 18 for receiving the combustion gases 24. The gases are then channeled to a conventional high pressure turbine rotor 28 which includes a plurality of circumferentially spaced apart rotor blades 28*a* extending radially outwardly from a rotor disk 28*b* joined by a suitable drive shaft to the compressor 14 in a conventionally known manner. The rotor blades 28*a* extract energy from the combustion gases 24 for powering the compressor 14 during operation.

In accordance with the present invention, the turbine nozzle 26 includes a circumferentially continuous annular outer band 30 which is a one-piece, 360° component. The outer band 30 includes an integral radially outwardly extending flange 30*r* having a plurality of circumferentially spaced apart holes for receiving suitable fasteners which join the outer band 30 to an adjacent conventional shroud assembly 32 of the high pressure turbine.

The nozzle 26 further includes a plurality of circumferentially spaced apart airfoils or vanes 34 having radially outer ends suitably fixedly joined to and extending radially inwardly from the outer band 30. The nozzle 26 also includes in accordance with the present invention a circumferentially segmented inner band 36 which is suitably fixedly joined to radially inner ends of the vanes 34 and disposed coaxially or concentrically with the outer band 30. The nozzle 26 may have any conventional form and configuration for suitably mounting it in the engine 10 between the combustor 18 and the turbine blades 28*a*.

Figure 2:
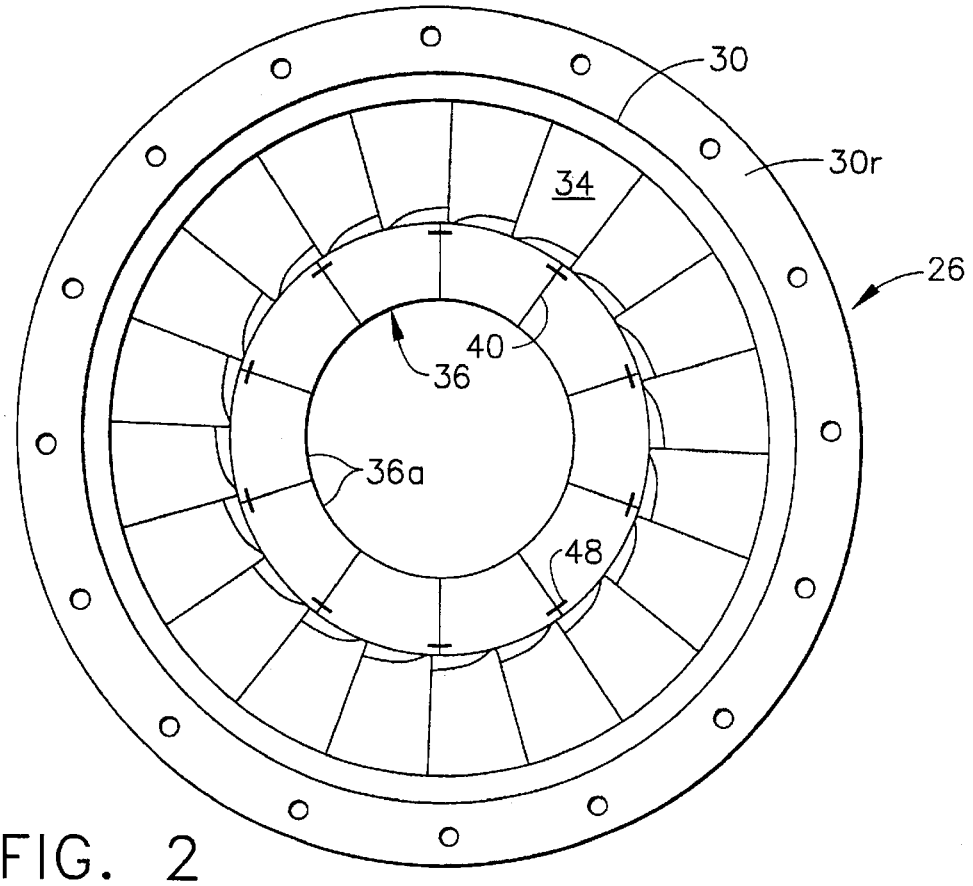
FIG. 2 is an elevational, aft facing view of the turbine nozzle illustrated in FIG. 1 taken along line 2—2 and isolated from the engine.
Figure 3:
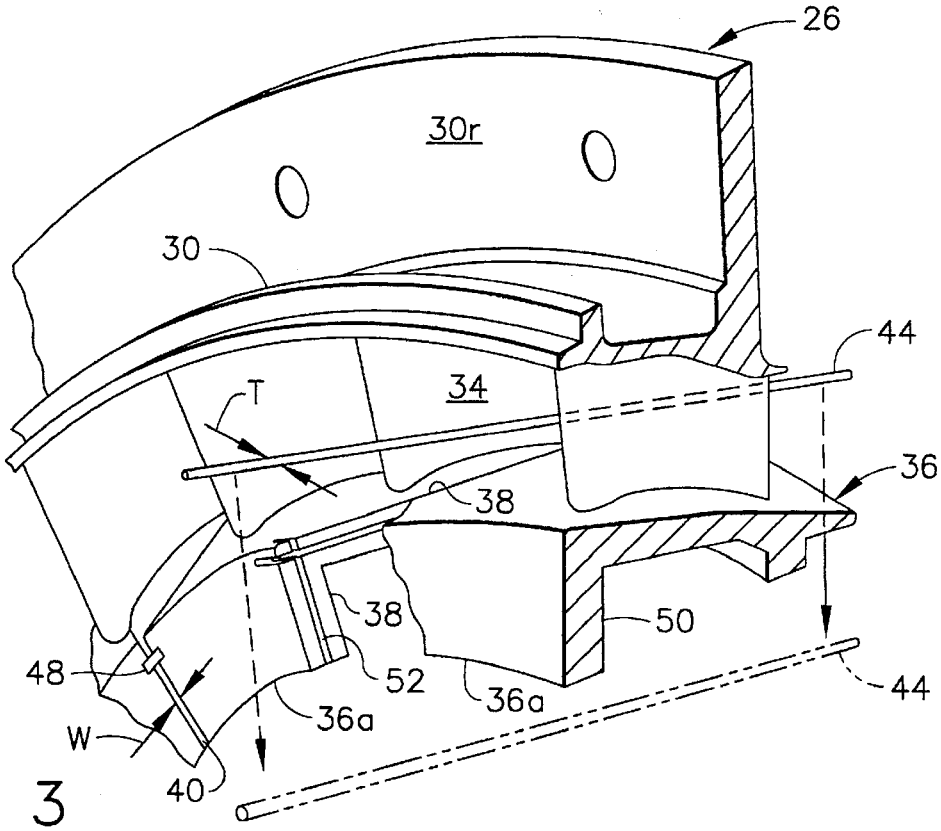
FIG. 3 is an enlarged, partly sectional isometric view of a portion of the turbine nozzle shown in FIG. 2 illustrating a continuous outer band and a segmented inner band having a plurality of vanes extending radially therebetween.

An isolated view of the turbine nozzle 26 itself is illustrated from its front in FIG. 2, and an enlarged partly sectional view of a portion thereof is illustrated in FIG. 3. The inner band 36 is piecewise annular and includes a plurality of circumferentially adjoining arcuate segments 36*a*. Adjacent ones of the segments 36*a* have circumferentially facing slash or end faces 38 which are circumferentially spaced apart to define a relatively small circumferential gap 40 therebetween. The oppositely facing corresponding end faces 38 of adjacent segments 36*a* are mirror images of each other and define the gap 40 which extends completely axially and radially through the inner band 36 to form separate and discrete inner band segments 36*a*. Each segment 36*a* may have one or more of the vanes 34 joined thereto, with a maximum of two or three vanes per segment 36*a* being preferred for minimizing thermal restraint against the vanes 34 by the outer band and inner band segment which may occur during thermal operation of the engine. This in turn reduces the corresponding thermal stresses, and the thermal mismatch in position between adjacent inner band segments 36*a*.

In accordance with one feature of the present invention, the turbine nozzle 26 may be initially formed using any conventional process including casting or fabrication. The vanes 34 may be integrally cast with the outer and inner bands 30, 36 or may be assembled thereto and then brazed. Initially, the inner band .36 is a continuous 360° annular member as shown in part in FIG. 4, which improves the manufacturing process and accuracy of assembly since only three basic components are required, i.e. the outer band 30, the vanes 34, and the inner band 36. They may be initially assembled and accurately aligned relative to each other, and to form substantially equal throat areas between the adjacent vanes 34.

After the individual vanes 34 are suitably fixedly joined to the outer and inner bands 30, 36, the inner band may be suitably cut to form the individual segments 36*a*. This is shown schematically in FIGS. 3 and 4 wherein a conventional electrical discharge machining (EDM) apparatus 42 includes an EDM wire 44 which is used for cutting the inner band 36 sequentially at a plurality of circumferentially spaced apart locations to form the corresponding gaps 40, and thereby form the plurality of circumferentially adjoining arcuate segments 36*a* with the opposite facing end faces 38.

As shown in FIG. 3, the wire 44 may be suitably inserted between adjacent vanes 34 and joined to the EDM apparatus 42 and translated radially inwardly for cutting a corresponding one of the gaps 40 completely axially and radially through the inner band 36. The corresponding end faces 38 and gap 40 are preferably diagonally oriented since the vanes 34 define an angled through passage therebetween. This first step of EDM cutting through the inner band 36 is sequentially repeated around the circumference of the inner band 36 until the desired number of segments 36*a* is formed. For example, each inner band segment 36*a* may be joined to one, two, or three vanes 34 per segment as desired, with the recognition that the more vanes per segment the greater will be the undesirable restraint in each segment causing increased thermal stress during temperature changes and temperature gradients.

By severing the inner band 36 into a plurality of discrete circumferential segments, the hoop load carrying capability of the inner band 36 is eliminated and thus uncouples thermal expansion and contraction of the inner band 36 from the continuous annular outer band 30. This significantly reduces thermal stresses in the components which would otherwise be caused by hoop restraint due to differential thermal expansion and contraction therebetween. The outer band 30 and inner band segments 36*a* are allowed to expand and contract without restraint from each other, with expansion of the vanes 34 causing the inner band segments 36*a* to move radially inwardly relative to the outer band 30.

Besides uncoupling the thermal movement between the outer and inner bands, the segmented inner band nozzle 26 provides additional significant advantages. Since the outer band 30 is circumferentially continuous there are no gaps for potential leakage paths therethrough. Relatively few potential leakage paths are provided solely in the segmented inner band 36, with the more vanes 34 per segment decreasing the required number of gaps 40. The use of EDM machining to form the gaps 40 allows relatively narrow gaps which minimize potential flow area and are more readily effectively sealed. In a preferred embodiment, each of the gaps 40 has a circumferential width W as illustrated in FIG. 3 which is substantially no wider than the thickness T of the EDM wire 44 which is used to cut or form the gaps 40.

Furthermore, the outer and inner bands 30, 36 and integral vanes 34 may be initially formed by any suitable conventional method including a one-piece casting of these components, hi-casting in stages, or fabrication wherein the vanes 34 are brazed into precast or prefabricated bands 30,36. By initially manufacturing the annular nozzle 36 as a complete 360° component, accurate throat areas between the vanes 34 may be maintained from vane-to-vane. And, accurate throat areas are still maintained after the individual band segments 36*a* are formed by EDM cutting since the vanes 34 remain firmly attached to the continuous outer band 30. The continuous outer band 30 also maintains the accurate position of the vanes 34 relative to each other during operation and under differential temperature and temperature gradients in the nozzle 26. This construction of the nozzle 26 provides significant advantages over a conventional nozzle segmented in both its inner and outer bands which must be separately manufactured and assembled in arcuate nozzle segments and accurately maintained in alignment during operation.

Yet further, the 360° nozzle 26 also reduces the required machining cycle for its production. A conventional multi-segment nozzle requires a machine set up and turning for each segment in multiple operations. The 360° nozzle 26 requires a single set up and machining operation for turning all the integral segments fixedly joined thereto in one lathe turning operation for preparing the various axial sealing surfaces thereof.

Yet further, the continuous outer band 30 maintains effective alignment of not only the individual vanes 34 but also the inner band segments 36*a* so that suitable spline seals may be used therein, and are less subject to misalignment of the adjacent band segments 36*a*.

Figure 4:
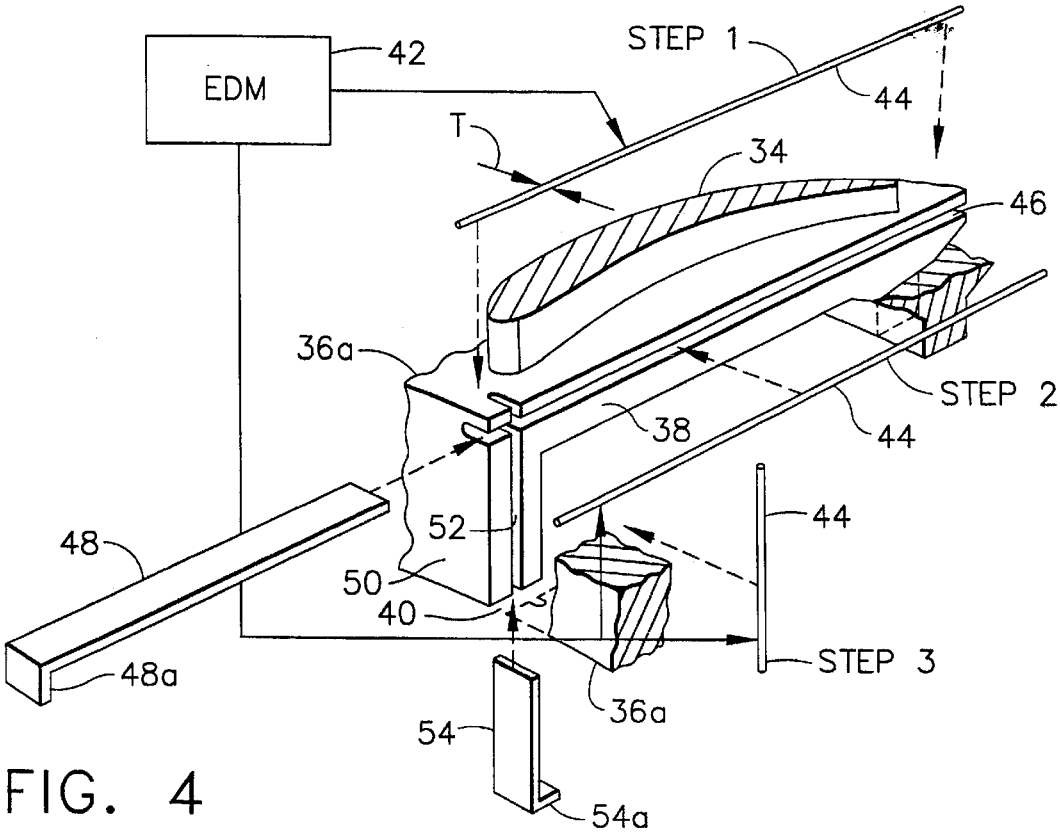
FIG. 4 is a schematic, partly exploded view of a portion of the inner band shown in FIG. 3 illustrating a method of segmenting an annular inner band and forming slots therein for receiving strip seals.

More specifically, and referring to FIG. 4, the EDM wire 44 may be used in a second step for cutting an axial seal slot 46 circumferentially into each of the end faces 38, with adjacent ones of the axial slots 46 in each of the gaps 40 being radially aligned with each other. Since the gap 40 between adjacent segments 36*a* is relatively narrow, the wire 44 provides an effective means for forming the axial seal slot 46 which could otherwise not be formed using conventional machining techniques. In the preferred embodiment illustrated in FIG. 4, the axial slots 46 extend completely axially through each of the segments 36*a* since the EDM wire 44 must be supported from two opposite ends on opposite sides of the inner band segment 36*a*.

An axial spline or strip seal 48 is disposed in each of the gaps 40 in a respective pair of the radially aligned axial slots 46 to provide a suitable seal therebetween. The axial seal 48 is preferably configured as an elongate thin plate for sliding insertion into the slots 46 from one end thereof, such as the front face of the inner band segments 36*a*. Each axial seal 48 preferably has an oblique or bent tab 48*a* at the outboard end thereof to limit sliding insertion of the seal 48 in the slots 46 by abutting against the front face of the inner segment 36*a*.

In the exemplary embodiment illustrated in FIG. 4, each of the inner band segments 36*a* includes an integral radially inwardly extending flange 50 at the forward end thereof which cooperates with the combustor 18 as illustrated in FIG. I in a conventional manner. The forming method of the nozzle 26 preferably also includes a third step, as illustrated schematically in FIG. 4, wherein the EDM wire 44 is repositioned vertically in each gap 40 and translated circumferentially to form a radial seal slot 52 disposed in each of the end faces 38 at the radial flange. Adjacent ones of the radial slots 52 in each of the gaps 40 are axially aligned with each other so that a radial spline or strip seal 54 may be disposed in each of the gaps 40 in a respective pair of the aligned radial slots 52 for providing an effective seal. The radial strip seal 54 is also configured as an elongate thin plate for sliding insertion into the radial slot 52 from one end thereof, such as the bottom end as illustrated in FIG. 4. The radial seal 54 also includes a bent or oblique tab 54*a* at the bottom end thereof for limiting sliding insertion of the radial seal 54 in the respective radial slot 52.

Since the gap 40 is relatively narrow, the EDM wire 44 provides a simple means for forming the radial slots 52 between the adjacent inner band segments 36*a*. Since the wire 44 is suitably held from opposite ends disposed above and below the inner band segments 36*a*, the radial slot 52 also extends completely radially through each of the segments 36*a*. In the exemplary embodiment illustrated in FIG. 4, respective ones of the radial and axial slots 46, 52 cross each other in the corner defined by the radial flange 50 joining the axially extending portion of the inner band segment 36*a*.

Figure 5:
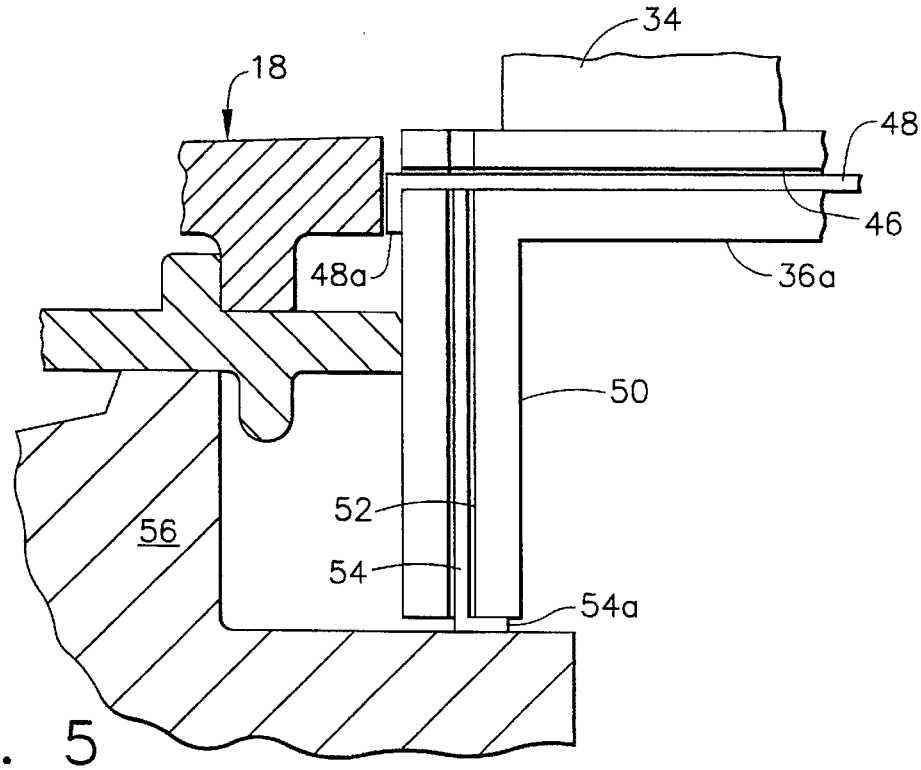
FIG. 5 is an elevational, partly sectional view of a portion of one of the inner bands illustrated in FIG. 3 showing the strip seals inserted into the slots.

As shown in FIG. 5, the axial strip seal 48 extends into the corresponding axial slot 46 from the front of the band segment 36*a*, with the radial strip seal 54 extending upwardly into the respective radial slot 52 until it abuts the axial strip seal 48. The corresponding tabs 48*a* and 54*a* of the seals abut the outer surfaces of the band segment 36*a* for accurately locating and retaining the seals 48, 54 between the band segments 36*a*. The seals 48, 54 may be suitably trapped for ensuring that they remain within the band segments 36*a*. And, in the exemplary embodiment illustrated in FIG. 5, an inner liner of the combustor 18 has an aft end which is positioned adjacent to the axial seal tab 48*a* to prevent withdrawal of the axial seal 48 during operation. And, an aft portion of an annular inner casing 56 is disposed radially below the radial flange 50 to trap and retain the radial seal tab 54*a* for preventing withdrawal of the radial seal 54 during operation.

The axial and radial strip seals 48, 54 are similar in sealing capability to those conventionally found between completely segmented conventional nozzle segments but enjoy additional advantages. The continuous outer band 30 ensures and maintains affective alignment of the inner band segments 36*a* to minimize alignment mismatch between the corresponding slots in which the axial and radial seals 48, 54 are mounted. An improved seal is thereby effected, and the relatively narrow gap width W also ensures a smaller potential leakage flowpath for also improving sealing efficiency.

The improved low leakage turbine nozzle 26 disclosed above provides significant advantages in manufacturing, machining, alignment, thermal performance, and seal efficiency. It may be used in differently sized turbine nozzle, including relatively small turbine nozzles, and those having low solidity and high aspect ratio vanes. The nozzle inner band 36 may have any conventional cross sectional configuration, with suitable axial or radial seals, or both, being provided therein using the simple wire EDM machining process to form the required slots therefor, as well as initially forming the inner band segments 36*a* themselves from an initially continuous 360° component.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A gas turbine engine turbine nozzle comprising:

a circumferentially continuous, one-piece annular outer band;

a plurality of circumferentially spaced apart vanes fixedly joined to and extending radially inwardly from said outer band; and a circumferentially segmented inner band fixedly joined to said vanes and disposed coaxially with said outer band, said inner band including a plurality of circumferentially adjoining arcuate segments, adjacent ones of which having circumferentially facing end faces spaced apart to define a gap therebetween.

2. A nozzle according to claim 1 further comprising an axial seal slot disposed in each of said end faces, with adjacent ones of said axial slots in each of said gaps; being radially aligned with each other.

3. A nozzle according to claim 2 wherein said axial slot extends completely axially through said segments.

4. A nozzle according to claim 3 wherein each of said gaps is substantially no wider than the thickness of an electrical discharge machining wire used to form said gaps.

5. A nozzle according to claim 3 wherein each of said segments includes a radial flange at one end thereof, and further comprising a radial seal slot disposed in each of said end faces at said radial flanges, with adjacent ones of said radial slots in each of said gaps being axially aligned with each other.

6. A nozzle according to claim 5 wherein respective ones of said radial and axial slots cross each other, with said radial slots extending completely radially through said segments.

7. A nozzle according to claim 6 further comprising an axial strip seal disposed in each of said gaps in a respective pair of said axial slots, and a radial strip seal disposed in each of said gaps in a respective pair of said radial slots.

8. A nozzle according to claim 7 wherein said axial and radial seals are configured for sliding insertion into said slots from one end thereof.

9. A nozzle according to claim 8 wherein said axial and radial seals each have an oblique tab at one end thereof to limit sliding insertion of said seals in said slots.

10. A method of forming a gas turbine engine turbine nozzle comprising:

joining a plurality of circumferentially spaced apart vanes to a one-piece annular radially outer band and to a one-piece annular radially inner band coaxial therewith; and cutting said inner band at a plurality of circumferentially spaced apart locations to form a plurality of circumferentially adjoining arcuate segments, adjacent ones of which having circumferentially facing end faces spaced apart to define a gap therebetween.

11. A method according to claim 10 further comprising cutting an axial seal slot in each of said end faces, with adjacent ones of said axial slots in each of said gaps being radially aligned with each other.

12. A method according to claim 11 wherein each of said segments includes a radial flange at one end thereof, and the method further comprises cutting a radial seal slot in each of said end faces at said radial flanges, with adjacent ones of said radial slots in each of said gaps being axially aligned with each other.

13. A method according to claim 12 wherein said cutting steps use an electrical discharge machining wire to form said gap and axial and radial slots.

* * * * *